United States Patent [19]

Miller

[11] 4,012,050

[45] Mar. 15, 1977

[54] SKI PROTECTOR

[76] Inventor: Charles Miller, 17 Sutro Heights, San Francisco, Calif. 94121

[22] Filed: Sept. 29, 1975

[21] Appl. No.: 617,650

[52] U.S. Cl. ..... 280/11.38; 280/11.37 A; 150/52 R

[51] Int. Cl.[2] ..... A63C 11/20

[58] Field of Search ..... 280/11.38, 11.37 E, 280/11.37 A, 11.37 K, 11.13 T, 11.13 R, 11.13 L, 11.13 G, 11.13 M, 28, 601, 610, 603; 224/5 Z, 45 S; 150/52 R, 1.5

[56] References Cited

UNITED STATES PATENTS

| | | | |
|---|---|---|---|
| 1,925,697 | 9/1933 | Johnson | 280/11.38 |
| 2,150,988 | 3/1939 | Russell | 280/11.38 X |
| 2,180,686 | 11/1939 | Lorinovich | 280/11.37 K |
| 2,699,809 | 1/1955 | Nebe et al. | 150/52 L |
| 3,120,963 | 2/1964 | Seckel | 280/28 |
| 3,841,648 | 10/1974 | Meyer | 280/11.37 A |
| 3,886,987 | 6/1975 | Schuchman | 150/52 R |

FOREIGN PATENTS OR APPLICATIONS

| | | | |
|---|---|---|---|
| 261,329 | 5/1965 | Australia | 150/52 G |
| 95,128 | 3/1939 | Sweden | 280/11.13 R |
| 536,193 | 5/1941 | United Kingdom | 280/11.38 |

*Primary Examiner*—Joseph F. Peters, Jr.
*Assistant Examiner*—Milton L. Smith
*Attorney, Agent, or Firm*—Bruce & McCoy

[57] ABSTRACT

A protector for the edges and bottoms of skis comprising a ski-shaped rubber boot having, along its edges, continuous walls of a height slightly greater than the thickness of a ski, the walls having upper inwardly projecting flanges for partially overlapping the upper surface of the ski, such that the boot can be stretched onto a ski with its bottom disposed against the sole, its sides abutting the walls of the sole, and its upper edges contacting the projection of the walls. The protector also includes a relatively resilient cap which covers the ski binding and interlocks with the boot to form an integral unit.

4 Claims, 4 Drawing Figures

SKI PROTECTOR

FIELD OF THE INVENTION

The present invention relates to ski protectors and more particularly to a device, attachable to a ski, to prevent dulling of ski edges and scratching of ski bottoms and foreign matter from penetrating the ski binding when the ski is not in use. It also serves to prevent injury to persons if they accidentally come into contact with the ski edges or bindings in a manner which might otherwise cause injury.

DESCRIPTION OF PRIOR ART

The sport of downhill skiing requires skis having sharp edges which will cut into the snow or ice, thereby allowing a skier to make turns and control his descent. Since most downhill skiing is done on hard, packed snow, it is especially important that the ski edges be kept in such sharp condition. Usually, the ski edges are made of separate steel strips bonded or otherwise secured to the ski. The edges are periodically sharpened to maintain the required degree of sharpness.

At present, there exists no protective device that a skier might attach to his skis when he is about to transport them to and from a ski slope, or before he puts them on a ski rack. Generally the skis are disposed together with their bottoms abutting and means are used to secure the skis together at their tips and tails such as by stretchable rubber straps that wrap around the skis and clip together at their ends. When transported over a considerable distance or through adverse conditions, the skis so secured may also be put into canvas or plastic bags. Few skiers employ any other means to protect either the edges or bottoms or the bindings of the skis. As a result, ski edges become dulled and ski bottoms and tops can be damaged much sooner than if such surfaces were protected. Additionally, the bindings can become dirty causing them to malfunction depriving them of their safety function.

Leaving ski edges unprotected also results in a risk of injury for persons coming into contact with them. This possibility arises when skis are carried in crowds or where they might accidentally be swung against another person walking or standing nearby.

The present invention comprises a rubber-like boot having a sole portion with continuous walls along its edges, the walls being of a height slightly greater than the thickness of a ski and having upper inwardly projecting flanges for partially overlapping the upper surface of the ski such that the boot can be stretched onto a ski positioned with its bottom against the inner sole of the boot, its sides closely surrounded by the walls of the boot, and its upper edges engaged under the flanges on the walls.

The portions of the ski protector formed for disposition along the longitudinal corner edges of the skis are formed of a greater or depth of cross-section thickness so as to insulate the edges of the skis from damage or causing damage when brought into contact with another object.

The protective boot can be readily slipped over a ski placed in an upright position. The boot is continuous along its length, walls, and projections, so that all of the ski edges, as well as its bottom will be completely enclosed within the protective material. A pair of skis, each encased in the protective device, may then be secured together and safely carried about.

The present invention also includes a protector for the safety bindings on the skis. It is formed to cover the binding with a bubble like enclosure having edges which seal against the top surface of the ski and the lateral portions of the edges of the cover are captured under the intermediate portions of the flanges of the ski protector to hold the cover in place over the bindings. The safety binding cover portion of the ski protector prevents the bindings from being damaged and more importantly keeps dirt out of the binding operational mechanism. Even small amounts of dirt can cause a safety binding mechanism to become inoperable thereby endangering the skier. The binding protector is especially useful when the skis are being carried on tops of cars in ski racks. Cars, and skis so carried, become especially dirty in the road snow level areas where the elevation is such that the snow is melting on the road and the roads are wet.

The ski protector of the present invention provides a practical and extremely valuable means for protecting the edges and bottoms and the bindings of skis during all the times the skier has to carry them about at the ski area or when they are in a ski rack, or being transported to and from the ski area. When the skier is ready to ski, the ski protectors may be quickly pulled off, rolled up, and either carried by the skier or left in a repository. In addition, because of the inexpensive materials used in fabricating the ski protector, a skier can obtain protectors for his skis at a relatively low cost.

The ski protector also renders the skis safe in crowds. The rubber boot completely blunts the sharpness of the edges should the skis be accidentally bumped against someone.

SUMMARY OF THE INVENTION

The present invention is a protector for the edges and bottom of a ski and comprises an elastic rubber-like boot having a sole portion with continuous walls there along in the outline of a ski. The walls are of a height slightly greater than the thickness of the ski and have upper inwardly projecting flanges for partially overlapping the upper surface of the ski. The portion of the ski protector formed for disposition along the edges of the skis is formed of a greater cross-section thickness to insulate the edges of the skis from damage or causing damage when brought into contact with another object. The boot is formed to permit it to be stretched over the ski such that the sole portion is positioned against the bottom of the ski with the sides of the ski closely surrounded by the walls of the boot and the edges of the upper surface of the ski are overlapped by the wall flanges.

The invention also includes a protective cover for the safety binding of the ski which is formed to seal with the upper surface of the ski around the binding to encapsulate the binding thereunder. The cover is held in position by having its lateral edges captured under the flange portions of the ski protector proximate the bindings when the protector is fitted onto the ski.

OBJECTS OF THE INVENTION

It is an important object of the present invention to provide a protective device for a ski which will prevent the edges of the ski from becoming rusted, dulled or damaged.

It is another object of the present invention to provide a lightweight, low cost protective device for the edges and bottom of ski which is resilient and would protect a person from being injured by the exposed sharpness of the edges.

It is a further object of the present invention to provide a ski protector which can be carried on the person of the skier when the protectors are not in use.

It is yet another object of the present invention to provide a ski protector which will fit various sized skis.

And it is still a further object of the present invention to provide a ski protector which prevents dirt from penetrating the safety release bindings which might cause them to malfunction in use.

DESCRIPTION OF PREFERRED EMBODIMENT

Figure 1:
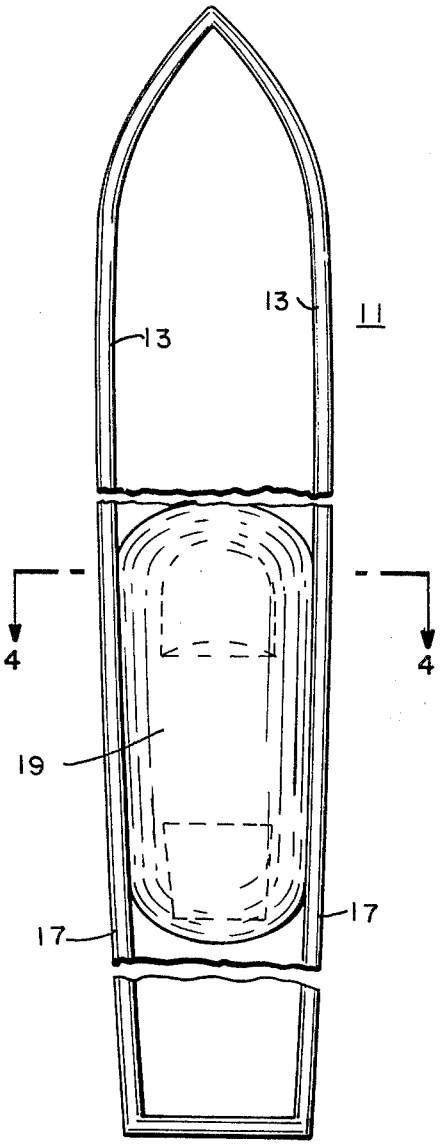
FIG. 1 of the drawings is a top plan view of a ski fitted with the ski protector of the present invention.

The ski protector 11 of this invention is a boot formed of a continuous strip of stretchable rubber, such as polybutylene, or any similar rubber material which retains its stretchability at low winter temperatures. The particular rubber employed must be capable of stretching onto a ski which is longer than the protector in its unstretched condition. Additionally, the rubber material must be sufficiently rigid such that the wall flanges 13 of the attached protector will not pull away from the ski edges as the ski is being carried.

The dimensions of the walls 15 and wall flanges are not critical. It is only necessary that the walls project above the top of the ski such that the wall flanges will maintain adequate contact with the upper edges of the skis. The thickness of the rubber material making up the boot is similarly dependent on the need to fabricate a boot having the intrinsic structural strength to stretch the length necessary to enclose the bottom and edges of the skis. The portion 17 of the boot formed for disposition along the edges of the skis are preferably formed of a greater or thicker cross-section, so as to insulate the edges of the skis from damage or to prevent injury or damage when brought into contact with another object.

Since it is an important feature of the invention that the ski protector be quickly and easily attachable to a ski, the device is preferably formed of a continuous single-walled strip of rubber, without the cross-pieces or reinforcement members running between the flanges 13 on top of the side walls 15 of the protector: the protector is open over its upper surface. The inherent rigidity of the walls and the wall flanges inparted by the thickness of the material are alone sufficient to firmly hold the protector on and along the upper ski surface edges. However, where a lower rigidity rubber is employed, snap on cross-pieces or reinforcement members may be required across the tops of the walls to hold the protector on the ski.

Preferably, the ski protector of this invention is formed in a continuous molding process, resulting in a one piece rubber-like boot. It is anticipated that three sizes of ski protector will accommodate the variety of ski lengths now in use: one size being stretchable to fit skis from lengths of 150 centimeters to 170 centimeters; the next size being stretchable to fit skis of lengths from 170 centimeters to 190 centimeters; and the third size being stretchable to fit skis of lengths from 190 to 210 centimeters.

The binding protectors 19 are preferably made of a resilient molded material, such as a plastic or rubber, whereby they maintain their shape but can be stretched if necessary to conform to the binding configuration. The skier could remove these upon his arrival at the ski area and leave them in a repository. The ski protector portion would remain on the ski until it was to be used. Then the ski protector could be carried on the person of the skier. It is within the scope of the invention that the binding cover could likewise be made of such a resilient material that it could also be collapsed like the ski protector and carried on the person of the skier.

The binding protector 19 is formed in the shape of a blister or bubble and the edges 21 which seal with the upper surface of the ski contact the surface somewhat tantentially. The lateral edges 21 of the cover are formed to fit under the flanges 13 disposed on the tops of the walls 15 of the ski boot whereby the cover is held in position on the upper ski surface covering the ski bindings. It is within the scope of the invention that the edges of the binding cover and the respective portion of the underside of the flange of the ski boot could be provided with the Velcro fasteners whereby the cover can be more securely fastened in place. Likewise any one of a number of different type quick release straps could be used to surround the ski and binding cover to hold it in place.

It is anticipated that the ski protectors will be utilized with pairs of skis in conjunction with means for securing the bottoms of the protected skis together. Accordingly, mating, releasable adhesive strips 23, such as Velcro fasteners, are affixed across the bottoms of the soles of the boots in opposed mating relation such that when the skis are pressed with their bottoms in opposed abutting relation, the adhesive strips will engage each other to secure the boots together for transporting the skis as a single unit. However, any suitable means, including the rubber straps presently used to clip together skis in an unprotected state may be utilized for securing together skis fitted with the ski protectors.

The ski protector of this invention can be quickly fitted onto a ski whether out-of-doors or indoors. The ski is placed in upright position and the ski protector slipped on one end of the ski and stretched over the other end of the ski and the wall flanges of the rubber boot are then similarly stretched over the edges of the ski.

Figure 2:
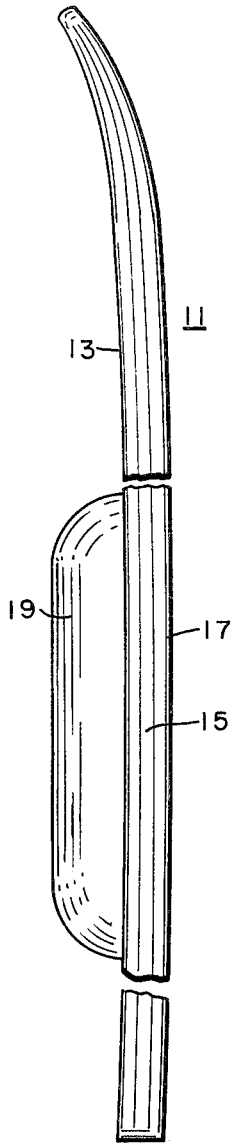
FIG. 2 is a side elevation view thereof.
Figure 3:
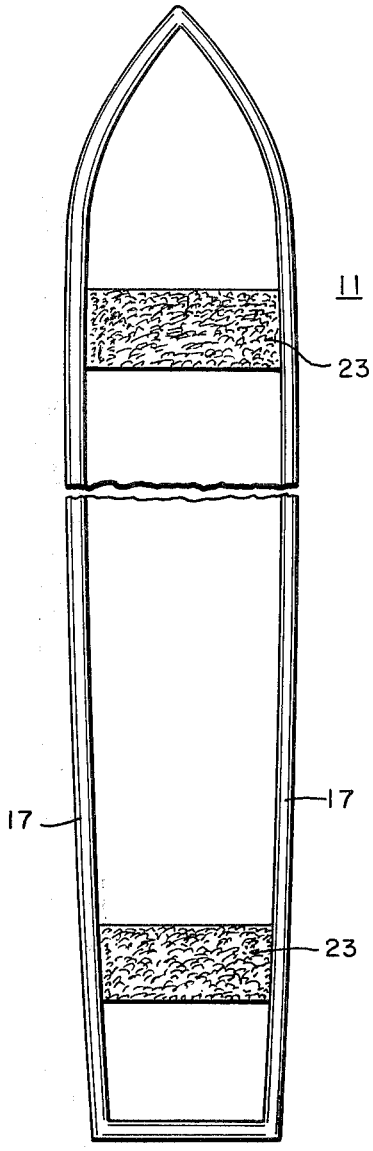
FIG. 3 is a bottom plan view thereof.

FIG. 1 illustrates a ski to which has been fitted a ski protector. The ski protector provides a protective cover for the entire upper length of the ski as shown in FIG. 1 as well as for all sides of the ski as shown in FIG. 2, and for the entire bottom surface of the ski as shown in FIG. 3.

Figure 4:
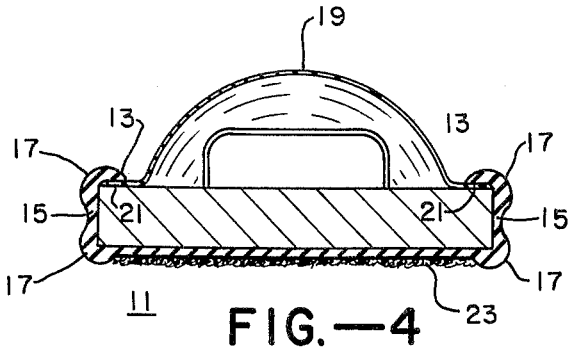
FIG. 4 is a cross-section view taken along line 4—4 of FIG. 3.

The attached ski protector, as shown in the cross-sectional view FIG. 4, overlaps and engages the upper edge of the ski by means of the flange 13. The walls 15 of the ski protector have built-up edges 17 of greater cross-sections to insure further cushioning and protection of the upper and lower edges of the skis.

The ski protector of the present invention is both useful and practical in that it provides a high degree of protection for the edges, the bottoms and the safety bindings of skis as they are being carried or transported as well as to the carrier and persons and things the carrier might hit with the skis. The low cost of the ski protector, as well as its ease of attachment, render it a highly useful addition to the ski equipment of any skier especially for keeping the ski running edges sharp.

I claim:

1. A ski protector comprising an elastic boot formed of one piece polybutylene rubber and having a sole portion with continuous walls therealong in the outline of a ski, the walls being of a height slightly greater than thickness of a ski and having upper inwardly projecting flanges for partially overlapping the upper surface of a ski, the portions of the ski protector formed for disposition along the edges of the skis being formed of a greater depth of cross-section thickness to insulate the edges of the skis from damage or causing damage when brought into contact with another object, said boot being formed to permit it to be stretched over the bottom and sides and the edges of the top surface of the ski such that the sole portion is positioned against the bottom of the ski with the sides of the ski closely surrounded by the walls of the boot and the edges of the upper surface of the ski being overlapped by the inwardly projecting flanges on the walls, mating releasable strips affixed across the bottoms of the soles of the boots in opposed mating relation such that when the skis are pressed with their bottoms in abutting relation the adhesive strips will engage each other to secure the boots together for transporting the skis enclosed therein as a single unit, and a protective cover for the safety bindings of skis, said cover being formed to seal with the upper surface of a ski disposed in said boot around said binding and to encapsulate said binding thereunder, said cover being held in position by having its lateral edges captured under the flange portions of said ski protector proximate said bindings when said protector is fitted onto said ski.

2. A ski protector comprising an elastic rubber-like boot, having a sole portion with continuous walls therealong in the outline of a ski, the walls being of a height slightly greater than the thickness of a ski and having upper inwardly projecting flanges for partially overlapping the upper surface of the ski, the portions of the ski protector formed for disposition along the edges of the skis being formed with a radius of generation whereby the material of the ski protector projects outwardly from the external surface of an enclosed ski a greater distance than the adjacent material which encloses the flat surfaces of the ski to insulate the edges of the skis from damage or causing damage when brought into contact with another object, said boot being formed to permit it to be stretched over the bottom and sides and the edges of the top surface of the ski such that the sole portion is positioned against the bottom of the ski with the sides of the ski closely surrounded by the walls of the boot and the edges of the upper surface of the ski being overlapped by the inwardly projecting flanges on the walls.

3. A ski protector comprising an elastic rubber-like boot, having a sole portion with continuous walls therealong in the outline of a ski, the walls being of a height slightly greater than the thickness of a ski and having upper inwardly projecting flanges for partially overlapping the upper surface of the ski, the portions of the ski protector formed for disposition along the edges of the skis being formed of a greater depth of cross-section thickness to insulate the edges of the skis from damage or causing damage when brought into contact with another object, said boot being formed to permit it to be stretched over the bottom and sides and the edges of the top surface of the ski such that the sole portion is positioned against the bottom of the ski with the sides of the ski closely surrounded by the walls of the boot and the edges of the upper surface of the ski being overlapped by the inwardly projecting flanges on the walls, and means for securing a pair of ski protectors together with their soles in opposed abutting relation such that skis enclosed therein can be easily carried, said means including mating, releasable adhesive strips affixed across the bottoms of the soles of the boots in opposed mating relation such that when the ski protectors are pressed with their bottoms in opposed abutting relation, the adhesive strips will engage each other to secure the boots together for transporting skis enclosed therein as a single unit.

4. A ski protector comprising an elastic rubber-like boot, having a sole portion with continuous walls therealong in the outline of a ski, the walls being of a height slightly greater than the thickness of a ski and having upper inwardly projecting flanges for partially overlapping the upper surface of the ski, the portions of the ski protector formed for disposition along the edges of the skis being formed of a greater depth of cross-section thickness to insulate the edges of the skis from damage or causing damage when brought into contact with another object, said boot being formed to permit it to be stretched over the bottom and sides and the edges of the top surface of the ski such that the sole portion is positioned against the bottom of the ski with the sides of the ski closely surrounded by the walls of the boot and the edges of the upper surface of the ski being overlapped by the inwardly projecting flanges on the walls, and a protective cover for the safety bindings of a ski disposed in said boot, said cover being formed to seal with the upper surface of said ski around said binding and to encapsulate said binding thereunder, said cover being held in position by having its lateral edges captured under the flange portions of said ski protector proximate said bindings when said protector is fitted onto said ski.

* * * * *